US008006872B2

(12) United States Patent
Vanblaere et al.

(10) Patent No.: US 8,006,872 B2
(45) Date of Patent: Aug. 30, 2011

(54) PRESSURE PACKAGE SYSTEM

(75) Inventors: Roland Frans Cyrille Cornelius Vanblaere, Houthalen Helchteren (BE); Willy Leonard Alice Kegels, Sint Gillis Wass (BE)

(73) Assignee: I.P.S. Research and Development B.V., Vlijmen (NL)

( * ) Notice: Subject to any disclaimer, the term of this patent is extended or adjusted under 35 U.S.C. 154(b) by 989 days.

(21) Appl. No.: 10/542,831

(22) PCT Filed: Jan. 21, 2004

(86) PCT No.: PCT/IB2004/000160

§ 371 (c)(1),
(2), (4) Date: Sep. 22, 2005

(87) PCT Pub. No.: WO2004/065261

PCT Pub. Date: Aug. 5, 2004

(65) Prior Publication Data

US 2007/0164039 A1 Jul. 19, 2007

(30) Foreign Application Priority Data

Jan. 21, 2003 (NL) ..... 1022456

(51) Int. Cl.
*B67D 7/60* (2010.01)

(52) U.S. Cl. ..... 222/389; 222/386; 222/396; 222/399

(58) Field of Classification Search ..... 222/386.5, 222/389, 386–387, 396, 399, 94–96; 184/39; 137/505.41, 906

See application file for complete search history.

(56) References Cited

U.S. PATENT DOCUMENTS

| | | | | |
|---|---|---|---|---|
| 35,402 | A | 5/1862 | Thompson | |
| 2,163,597 | A | 6/1939 | Grove | |
| 2,195,242 | A | 3/1940 | Dow | |
| 2,261,364 | A | 11/1941 | Grove | |
| 2,618,908 | A | 11/1952 | Salter et al. | |
| 3,120,377 | A | 2/1964 | Lipschultz et al. | |
| 3,140,802 | A | 7/1964 | Everett | |
| 3,228,559 | A * | 1/1966 | Couffer | 222/61 |
| 3,421,698 | A | 1/1969 | Baltzer | |
| 3,556,128 | A | 1/1971 | Scaglione | |
| 3,561,644 | A | 2/1971 | Works et al. | |
| 3,913,613 | A | 10/1975 | Kostjunin et al. | |
| 4,257,560 | A | 3/1981 | Diamond | |

(Continued)

FOREIGN PATENT DOCUMENTS

BE 1004018 A3 9/1992

(Continued)

*Primary Examiner* — J Jacyna
(74) *Attorney, Agent, or Firm* — Fish & Richardson P.C.

(57) ABSTRACT

A pressure package system for providing a working pressure on a fluid included in a pressure package, the system being provided with a pressure package (2) in which a product chamber (4) is included for holding the fluid and in which a working pressure chamber is included for keeping a propellant at the working pressure, the system being further provided with a pressure controller (5) and a high-pressure chamber (6) connected with the pressure controller for keeping the propellant in supply at a relatively high pressure, the pressure package system being further provided with a wall (7) which is designed to be movable relative to the pressure controller, a first side (8) of the wall bounding the working pressure chamber at least partly and a second side (9) of the wall, facing away from the working pressure chamber, bounding the product chamber at least partly.

20 Claims, 5 Drawing Sheets

U.S. PATENT DOCUMENTS

| | | | | |
|---|---|---|---|---|
| 4,456,155 | A | 6/1984 | Miyata et al. | |
| 4,487,334 | A | 12/1984 | Werding | |
| 4,561,465 | A | 12/1985 | Rogers | |
| 4,650,094 | A | 3/1987 | Werding | |
| 4,940,169 | A | 7/1990 | Ball | |
| 5,033,505 | A | 7/1991 | Eidsmore | |
| 5,042,697 | A | 8/1991 | Warren | |
| 5,090,595 | A | 2/1992 | Vandoninck | |
| 5,179,982 | A * | 1/1993 | Berube et al. | 141/20 |
| 5,181,636 | A | 1/1993 | Anderson et al. | |
| 5,285,931 | A | 2/1994 | Alfons | |
| 5,303,734 | A | 4/1994 | Eidsmore | |
| 5,341,968 | A | 8/1994 | Vandoninck | |
| 5,368,207 | A | 11/1994 | Cruysberghs | |
| 5,423,454 | A * | 6/1995 | Lippman et al. | 222/1 |
| 5,514,135 | A | 5/1996 | Earle | |
| 6,026,850 | A | 2/2000 | Newton et al. | |
| 6,145,712 | A | 11/2000 | Benoist | |
| 6,617,017 | B2 | 9/2003 | Vant' Hoff | |
| 6,652,704 | B2 | 11/2003 | Green | |
| 6,851,575 | B2 | 2/2005 | Van't Hoff | |
| 2002/0179151 | A1 | 12/2002 | Van't Hoff | |

FOREIGN PATENT DOCUMENTS

| | | | |
|---|---|---|---|
| CH | 405851 | A | 1/1966 |
| DE | 1220688 | B | 7/1966 |
| DE | 4241074 | A1 | 1/1994 |
| EP | 0826608 | A1 | 3/1998 |
| EP | 0960827 | A1 | 12/1999 |
| FR | 474467 | A | 2/1915 |
| FR | 474476 | A | 2/1915 |
| FR | 973108 | | 2/1951 |
| FR | 1216484 | A | 4/1960 |
| FR | 1303048 | | 7/1962 |
| FR | 1390963 | | 3/1964 |
| FR | 1463058 | | 12/1966 |
| FR | 2208313 | | 6/1974 |
| FR | 2698341 | | 5/1994 |
| FR | 2754584 | | 4/1998 |
| GB | 1268569 | | 3/1972 |
| WO | WO 90/15377 | | 12/1990 |
| WO | WO 99/62791 | | 12/1999 |
| WO | WO 00/35774 | | 6/2000 |
| WO | WO 01/09009 | | 2/2001 |

* cited by examiner

PRESSURE PACKAGE SYSTEM

TECHNICAL FIELD

This application relates to a pressure package system for applying a working pressure to a fluid included in a pressure package.

CROSS-REFERENCE TO RELATED APPLICATIONS

This application is the national stage of international application no. PCT/IB2004/000160, filed 20 Jan. 2004, and claims priority to Dutch application no. NL1022456, filed 21 Jan. 2003. This application is also related to international application no. PCT/IB2004/000162, filed 20 Jan. 2004. Each of these applications is incorporated by reference herein.

BACKGROUND

The invention relates to a pressure package system for providing a working pressure on a fluid included in a pressure package, the system being provided with a pressure package in which a product chamber is included for holding the fluid and in which a working pressure chamber is included for keeping a propellant at the working pressure, the system being further provided with a pressure controller and a high-pressure chamber connected with the pressure controller for keeping the propellant in supply at a relatively high pressure, the system being further arranged to supply the propellant from the high-pressure chamber to the working pressure chamber with the aid of the pressure controller on the basis of a reference pressure, for maintaining the working pressure in the working pressure chamber.

Such a pressure package system is known from WO 99/62791. In this known system, the pressure controller with the high-pressure chamber connected thereto, is included in the pressure package as a pressure control device. The pressure package is of elongate and substantially cylindrical design. The pressure control device is so designed as to align with the inner walls of the cylinder jacket. The pressure control device can move in an axial direction of the pressure package under the influence of pressure differences in the pressure package. In this known system, the pressure control device constitutes the separation between the product chamber and the working pressure chamber. It will be clear that a "high-pressure chamber connected with the pressure controller" is understood to mean a high-pressure chamber and a pressure controller between which a fluid communication can be effected for the purpose of controlling the working pressure with the aid of a propellant from the high-pressure chamber.

The reference pressure is slightly lower than a predetermined working pressure which it is desired to apply to the fluid operatively included in the product chamber. The working pressure is a pressure to be kept substantially constant. The known system works as follows. When the pressure in the product chamber starts to decrease to a new pressure in the product chamber because, for instance, a user has allowed fluid to flow from the pressure package, the pressure control device moves, as a result of the pressure difference between the working pressure chamber and the product chamber, in the direction of the product chamber. The volume of the working pressure chamber thereby increases and, as a result, the pressure in the working pressure chamber decreases. In that case, the reference pressure is higher than the new pressure in the working pressure chamber. The pressure control device is arranged in that case to allow propellant to flow from the high-pressure chamber to the working pressure chamber. As a result, the pressure in the working pressure chamber increases until in the working pressure chamber the pressure has become slightly higher than the reference pressure. The working pressure is then higher than the pressure in the product chamber again, and under the influence of the pressure difference between the product chamber and the working pressure chamber the pressure control device moves a little further in the direction of the product chamber. Since the volume of the product chamber thereby decreases slightly, the pressure in the product chamber will increase slightly. With the decrease of the volume of the product chamber, the volume of the working pressure chamber increases again. The pressure in the working pressure chamber is then a bit lower again than the reference pressure, and the pressure control device will again allow a bit of propellant to flow to the working pressure chamber, etc.

When the pressure prevailing in the working pressure chamber is slightly higher than the reference pressure, the supply of propellant from the high-pressure chamber to the working pressure chamber will block. The pressure control device will then assume such a position that the pressure in the working pressure chamber and the pressure in the product chamber are equal to each other. In that case, this pressure will be the intended working pressure which is slightly higher than the reference pressure.

In the known system, for separating the working pressure chamber and the product chamber, the pressure control device is provided with sealings which abut the inner wall of the cylindrically designed pressure package in such in way as to provide a gas-tight closure between the working pressure chamber and the product chamber. Further, the sealings abut the inner wall in such a way that the pressure control device is still movable in the axial direction of the pressure package under the influence of a pressure difference between the working pressure chamber and the product chamber. The known pressure control device is of relatively heavy design and due to inertia is slow to get moving.

SUMMARY

The object of the invention is to provide a system with which the above-mentioned drawback of the known system is met. This object has been achieved with the system according to the invention, which is characterized in that the pressure package system is further provided with a wall which is designed to be movable relative to the pressure controller, a first side of the wall bounding the working pressure chamber at least partly and a second side of the wall, facing away from the working pressure chamber, bounding the product chamber at least partly. In many cases, this means that the wall is also movable relative to the pressure package. When the pressure in the product chamber has decreased because a user has allowed fluid to flow out of the pressure package, the wall moves in the direction of the product chamber. Since the wall is designed to be movable relative to the pressure controller, the wall can move without a movement of the pressure controller. The part moving under the influence of pressure differences can be made of very light design. The mass of the moving part, that is, the wall, hardly needs to require any additional pressure to get the movement going. The sensitivity of the wall to a pressure difference will be chiefly determined by frictional forces to be overcome. It is also possible for the wall to unfold, or, conversely, to fold up, under the influence of a pressure difference between the product chamber and the working pressure chamber, for reducing the volume of the product chamber. An advantage of the pressure package system according to the invention is that the wall can be made of relatively light design, resulting in a quick reaction of the wall to pressure differences between the product chamber and the working pressure chamber.

In a preferred embodiment, the wall comprises a plunger separating the working pressure chamber and the product chamber from each other. This makes it possible to design a very compact pressure package.

Preferably, the pressure package comprises a provision for opening the pressure package for the purpose of allowing the fluid operatively contained in the product chamber to flow out of it. This enhances the ease with which a user can allow the fluid to flow from the package.

In a particular embodiment, the first side of the wall bounds the working pressure chamber virtually completely. Further, in that case, preferably, the product chamber is furthermore partly bounded by the pressure package. This also enables a very compact design of the pressure package.

Thus, the working pressure chamber can comprise an inner space of a balloon in which, in use, the propellant can be received. When more propellant is admitted to the balloon, the balloon will increase in volume. The wall whose first side bounds the working pressure chamber is manufactured from elastic material in this case.

It is also possible, however, that the working pressure chamber comprises an inner space of a bellows in which, in use, the propellant can be received. The material from which the bellows is manufactured, at least in part, is of flexible design. In other words, in this case, the working pressure chamber is at least partly bounded by a flexible, movable wall.

In an alternative embodiment, the second side of the wall substantially completely bounds the product chamber. Further, in that case, preferably, the working pressure chamber is furthermore partly bounded by inner walls of the pressure package. This also enables a very compact pressure package design.

Thus, the product chamber can comprise a bag with an opening, the opening linking up with the provision provided in the pressure package for opening the pressure package. The wall whose second side bounds the product chamber is manufactured from a flexible material in this case. Preferably, the bag is manufactured from a material having a low coefficient of friction.

In this alternative embodiment, however, it is also possible that the product chamber comprises a bellows with an opening, the opening linking up with the provision provided in the pressure package for opening the pressure package. In use, the fluid can be contained in the bellows. The material of which the bellows is at least partly manufactured is of flexible design in this case too. In other words, in this case, the product chamber is at least partly bounded by a flexible, movable wall.

In a substantially ready-to-use pressure package system according to the invention, a propellant is included in the high-pressure chamber. Preferably, the propellant comprises a relatively inert gas. This enhances safety. Moreover, a relatively inert gas is environment-friendly. As a consequence, less stringent requirements need to be imposed on the pressure package system than is the case with pressure package systems that are provided with a less safe or harmful propellant. Although the gas does not come into contact with the fluid operatively contained in the product chamber, it is a reassuring idea for many users, especially when the fluid involves a food product, that no harmful effects can occur upon any contact between the propellant and the fluid. In an advantageous embodiment, the relatively inert gas comprises a gas from the group consisting of nitrogen and carbon dioxide. The reason is that these gases are abundant and cheap.

Furthermore, in a particular embodiment, the system is made of two-part design, with a first part comprising the pressure package and a second part comprising the pressure controller with the high-pressure chamber. This enables a well-organized design. By making the pressure package of two-part design in the manner indicated, the manufacture of the system is simplified. Incidentally, it is possible for the parts to be integrally connected with each other. This provides the advantage that a system is involved that does not include any loose parts.

In an alternative embodiment, however, the parts can be designed as loose items and be connectable with each other for use. Optionally, the parts are detachably connectable with each other. This provides the advantage that a pressure controller can be used, for instance, for various different pressure packages in succession.

Furthermore, preferably, the pressure package is manufactured substantially from a plastic material. This renders the pressure package lighter compared with a metal pressure package. Moreover, a pressure package manufactured from a plastic material can be cheaper than a pressure package manufactured from metal.

DESCRIPTION OF DRAWINGS

The invention will presently be elucidated with reference to a drawing. In the drawing.

Figure 1:
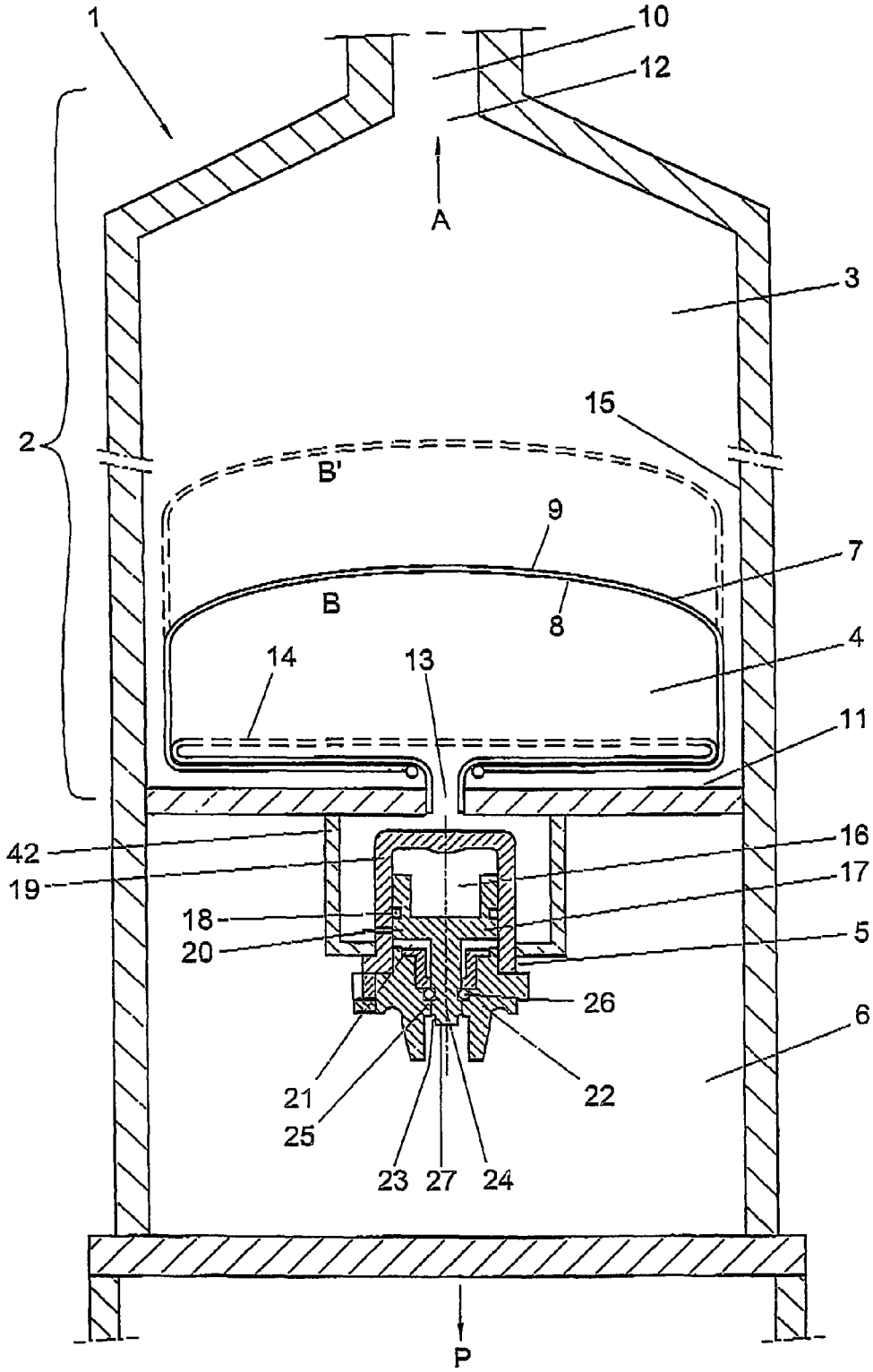
FIG. 1 schematically shows a cross section of a first embodiment of a pressure package system according to the invention.

Equal reference numerals denote equal parts in the drawing.

DETAILED DESCRIPTION

FIG. 1 shows a pressure package system 1 for providing a working pressure on a fluid (not shown) contained in a pressure package 2. System 1 is provided with the pressure package 2 in which a product chamber 3 is included for holding the fluid (not shown) and in which a working pressure chamber 4 is included for keeping a propellant (not shown) at the working pressure. The system is further provided with a pressure controller 5 and a high-pressure chamber 6, connected with the pressure controller 5, for keeping the propellant (not shown) in supply at a relatively high pressure. In other words, between the high-pressure chamber and the pressure controller, a fluid communication can be established for controlling the working pressure with the aid of propellant from the high-pressure chamber. The system 1 is arranged for adding, on the basis of a reference pressure, the propellant (not shown) from the high-pressure chamber 6 to the working pressure chamber 4 with the aid of the pressure controller 5, for preserving the working pressure that is to be substantially constant in the working pressure chamber 4. The reference pressure can be obtained, for instance, by a gas confined in the reference pressure chamber 16. Such a pressure controller 5 is known per se, for instance from WO 99/62791. The operation of such a pressure controller 5 as shown in FIGS. 1 to 5 will be further discussed when the operation of the system is discussed.

The pressure package system is further provided with a wall 7 which in this example is included in the pressure package. The wall 7 shown in FIG. 1 is of elastic and hence movable design. A first side 8 of the wall 7 bounds the working pressure chamber 4 substantially completely. A second side 9 of the wall 7, facing away from the working pressure chamber 4, bounds the product chamber 3 at least partly. The product chamber 3 is furthermore partly bounded by the pressure package 2. In the exemplary embodiment shown in FIG. 1, an inner space of the working pressure chamber 4 comprises a balloon B in which, in use, propellant (not shown) can be received. The pressure package 1 further comprises a provision for opening the pressure package 1 for the purpose of allowing the fluid (not shown) operatively contained in the product chamber 3 to flow out of the product chamber 3. In the exemplary embodiment shown in FIG. 1, the pressure package is substantially cylinder-shaped. The pressure package is provided with a first end 11 and a second end 12. Adjacent the first end, the pressure package is provided with an inlet opening 13 for the propellant (not shown). The provision 10 for opening the pressure package is situated adjacent the second end 12. The balloon B is of such design that the balloon B, when being filled with the propellant, stretches substantially in an axial direction (see arrow A) of the pressure package 1. In the exemplary embodiment shown, the balloon B is tensioned over an air distributor 14. After the filling of the balloon B with propellant, the balloon will stretch and assume a shape such as it is shown by the balloon B' represented in broken lines. It is possible here that parts of the balloon touch an inner wall 15 of the pressure package. It is also possible, however, that the balloon B, the air distributor, and the pressure package 2 are so dimensioned with respect to each other that when the balloon B is being filled, the second side 9 of the elastic wall 7 does not touch an inner wall 15 of the pressure package 2. In the latter case, there is no friction involved between the second side 9 of the wall 7 and the inner wall 15 of the pressure package 2.

The pressure package system 1 shown in FIG. 1 works as follows. In use, the fluid is contained in product space 3. In the high-pressure chamber 6, the propellant is held in supply at a relatively high pressure. The pressure controller 5 shown in FIG. 1 controls the preservation of the working pressure in the working pressure chamber 4 on the basis of the reference pressure. The pressure controller 5 shown is described at length in WO 99/62791. Therefore, the operation of the pressure controller 5 will be described only briefly. The pressure controller 5 is provided with a reference pressure chamber 16. Pressure controller 5 is further provided with a closing member 17, designed as a plunger in this example, movable relative to the reference pressure chamber 16. The reference pressure can be obtained, for instance, by a gas confined in the reference pressure chamber 16. The plunger 17 is provided with a sealing ring 18 for preserving the gas (not shown) received in the reference pressure chamber 16 with the reference pressure. The pressure controller 5 is further provided with a cylinder-shaped cap 19 which, together with the plunger 17, encloses the reference pressure chamber 16. The cap 19 is provided with a through-going recess 20 for effecting a gas communication between inlet opening 13 of the working pressure chamber and a space 21 which is provided between the plunger 17 and a closure 22 closing off the cap 19. For effecting the gas communication between the through-going recess 20 and the working pressure chamber, a part of the pressure controller 5 is included in a cylinder 42 which at one end connects to the inlet opening 13 of the working pressure chamber 4 and at another end is closed off by the pressure controller 5. The through-going recess 20 terminates on one side in the cylinder 42 and on the other side in the space 21. Closure 22 is furthermore provided with a passage 23 in which a stem 24 of the plunger 17 is received with a close fit. Stem 24 is provided with an annular recess 25 to enable the effectuation of a gas communication between the high-pressure chamber 6 and the space 21. The stem 24 of the plunger 17 can move in the passage 23 in the direction of arrow P, such that the gas communication between the space 21 and the high-pressure chamber 6 is established. In the situation that is shown in FIG. 1, the gas communication has been established. In this situation, a sealing ring 26 included in the passage 23 extends in the annular recess 25 and clears the passage for effectuation of the gas communication. When, from the position of the stem 24 shown in FIG. 1, the stem moves further in either the direction of arrow A or the direction of arrow P, the parts of the cylinder jacket of the stem 24 that are free of the annular recess 25 press against the sealing ring 26 and hence press the passage 23 shut; the gas communication is blocked and hence broken. The plunger 17 can therefore be moved from the situation shown in FIG. 1, in the direction of arrow A, such that the gas communication between the space 21 and the high-pressure chamber 6 is closed. The effectuation of the gas communication between the space 21 and the high-pressure chamber 6 is determined by the position of the annular recess 25 relative to the closure 22 and the position of the sealing ring 26 included in the passage 23 thereof. The closure of the gas communication between the space 21 and the high-pressure chamber 6 thus takes place at the sealing ring arranged in the passage 23. Such a pressure controller is suitable in particular to keep the working pressure substantially constant. FIG. 1 of WO 99/62791 and the description associated with FIG. 1 therein indicate in more detail how the pressure controller 5 can be designed and work.

In use, the reference pressure in the reference pressure chamber 16 will be slightly lower than the working pressure in the working pressure chamber 4. This means that when the product chamber 3 is closed, the working pressure is exerted on the fluid contained in the product chamber 3. When the pressure package is opened and the fluid is allowed to flow out of the product chamber 3, the pressure in the product chamber 3 decreases. The working pressure still prevailing in the working pressure chamber 4 is then higher than the pressure in the product chamber. The balloon B then stretches in the direction of arrow A. The balloon will then take the shape of balloon B'. The volume of the working pressure chamber 4 is thereby enlarged and therefore the pressure in the working pressure chamber 4 will decrease. The space 21 is in a gas communication with the working pressure chamber 4 by way of the through-going recess 20. Accordingly, when the pressure in the working pressure chamber 4 decreases, the pressure in the space 21 will also decrease. As a result of a lowered pressure in space 21, the plunger 17 moves in the direction of arrow P, at least when the reference pressure in the reference pressure chamber 16 is higher than the pressure in the space 21. It should be noted that a high pressure of the gas in the high-pressure chamber 6 as exerted on a subsurface 27 will hardly make a contribution to the position of the plunger, since this subsurface 27 is very small. As mentioned, when plunger 17 with the stem 24 moves in the direction of arrow P, the gas communication between the space 21 and the high-pressure chamber 6 is effected in the passage 23 via the annular recess 25. The situation is then as shown in FIG. 1. The propellant operatively contained in the high-pressure chamber will flow via this gas communication to the space 21. Via the through-going recess 20 provided in the cap 19, the propellant will flow via inlet opening 13 to the working pressure chamber 4. As a result, the pressure in the working pressure chamber 4 increases and the working pressure chamber 4, that is, the balloon B, will stretch further in axial direction (arrow A) of the cylinder-shaped pressure package. When in the working pressure chamber the working pressure is slightly higher again than the reference pressure in the reference pressure chamber, the plunger 17 will move in the direction of arrow A. The gas communication between the space 21 and the high-pressure chamber 6 is thereby closed off by the contact between the sealing ring 26 and the stem 24. When the pressure package after being opened is closed again, the working pressure will also be applied to the fluid contained in the product chamber 3.

Figure 2:
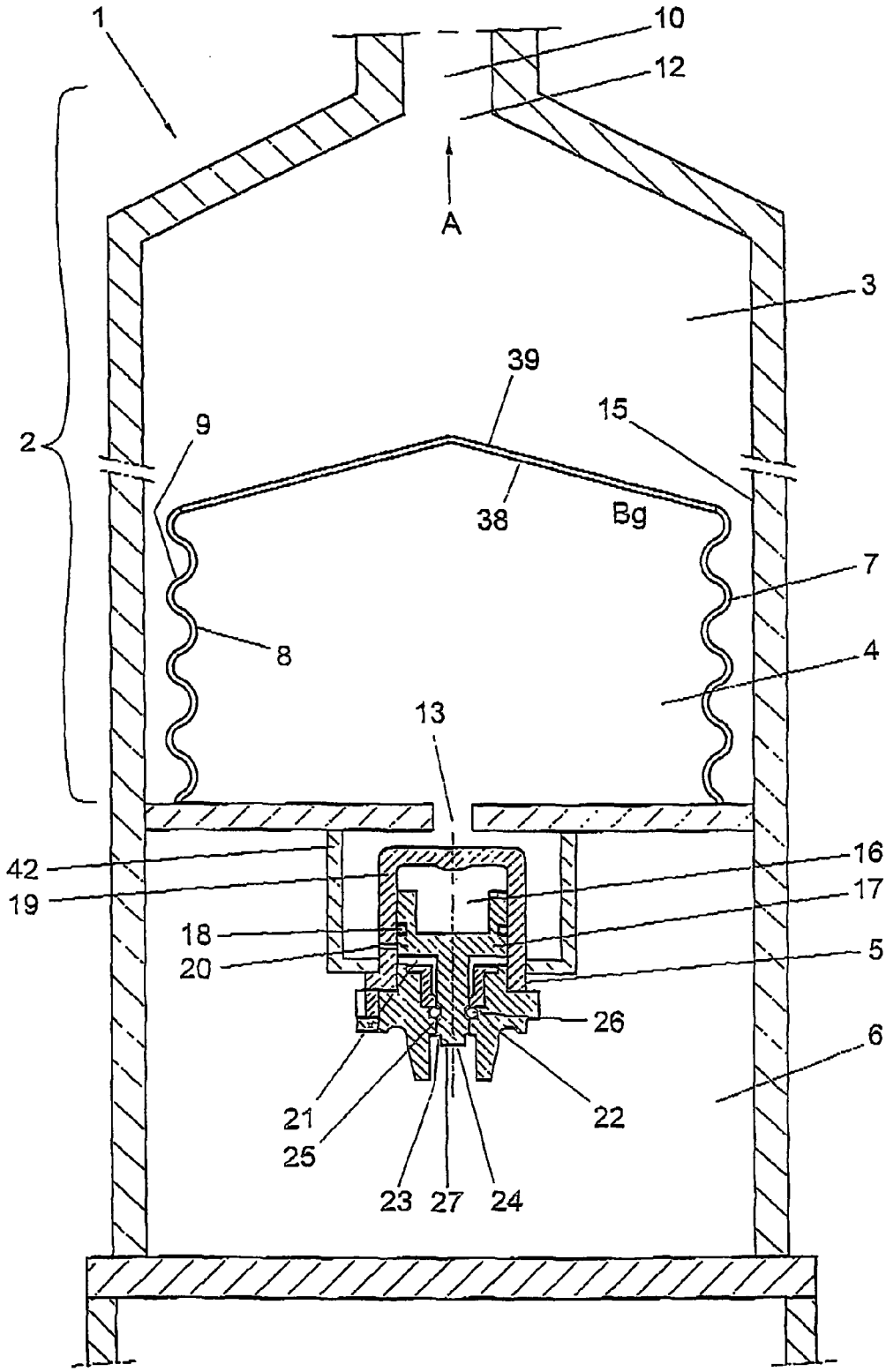
FIG. 2 schematically shows a cross section of a second embodiment of a pressure package system according to the invention.

FIG. 2 shows a schematic cross section of a second embodiment according to the invention. In this embodiment, the working pressure chamber 4 comprises an inner space of a bellows Bg in which, in use, the propellant can be received. The pressure package system 1 is provided with wall 7 which is included in the pressure package 2 and in this case is of flexible design. In the pressure package 2, in this case, a wall 7 is included which is of flexible and hence movable design. The first side 8 of the wall 7 bounds the working pressure chamber 4 at least partly. The second side 9 of the wall 7, facing away from the working pressure chamber 4, bounds the product chamber 3 at least partly. The bellows Bg further comprises a disc S which, on a side 38 facing the working pressure chamber 4, partly bounds the working pressure chamber 4 and on a side 39 facing the product chamber 3 partly bounds the product chamber 3. In the exemplary embodiment shown in FIG. 2, the disc S has a shape virtually conforming to an inner wall 40 situated near the first end 12 of the pressure package. The disc S is represented as not being contiguous to the inner wall 15 of the pressure package. However, it is possible for the disc S to abut this inner wall 15. In other words, instead of the balloon B, the bellows Bg is included in the pressure package. The other features and the operation of this pressure package system are equal to those as described in the description of the embodiment shown in FIG. 1.

Figure 3:
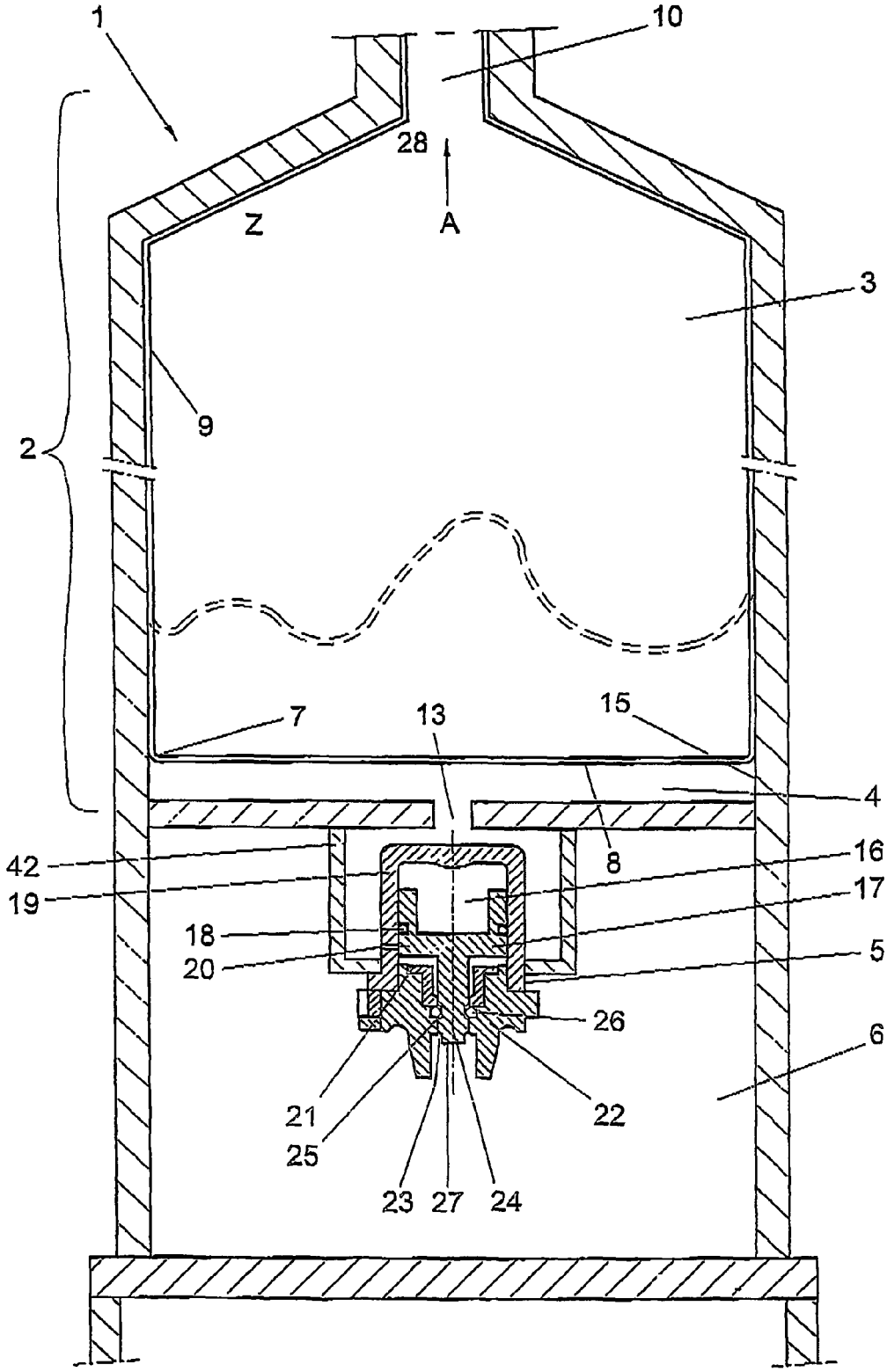
FIG. 3 schematically shows a cross section of a third embodiment of a pressure package system according to the invention.

FIG. 3 shows a schematic cross section of a third embodiment of a pressure package according to the invention. In this case, the pressure package system also has the pressure controller 5 and high-pressure chamber 6. However in contrast with the embodiments discussed above, the second side 9 of the wall 7 bounds the product chamber 3 virtually completely. The working pressure chamber 4 is partly bounded by the inner walls 15 of the pressure package 2. In this example, too, the wall 7 is of flexible and hence movable design. The first side 8 of the wall bounds the working pressure chamber 4 at least partly. In this example, product chamber 3 comprises a bag Z with an opening 28. Opening 28 links up with the provision 10 provided in the pressure package for opening the pressure package 2.

The operation of the pressure package system 1 shown in FIG. 3 is further equal to that of the embodiments shown in FIGS. 1 and 2. When the pressure in the product chamber 3 has decreased in that a user has allowed fluid to flow from product chamber 3, then, with the aid of the pressure controller 5, propellant will flow from the high-pressure chamber 6 to the working pressure chamber 4. The volume of the working pressure chamber 4 will thereby increase, and the flexible wall 7, or at least a part thereof, will move in the direction of the provision for opening the pressure package 2. When in the working pressure chamber 4 the working pressure prevails, the working pressure will also prevail in the product chamber 3. Here, at least a part of the wall 7 may have assumed a new position and shape, as is represented with the aid of the broken lines. Preferably, the bag is manufactured from a material having a low coefficient of friction. The operation is further equal to that of embodiments shown in FIGS. 1 and 2.

Figure 4:
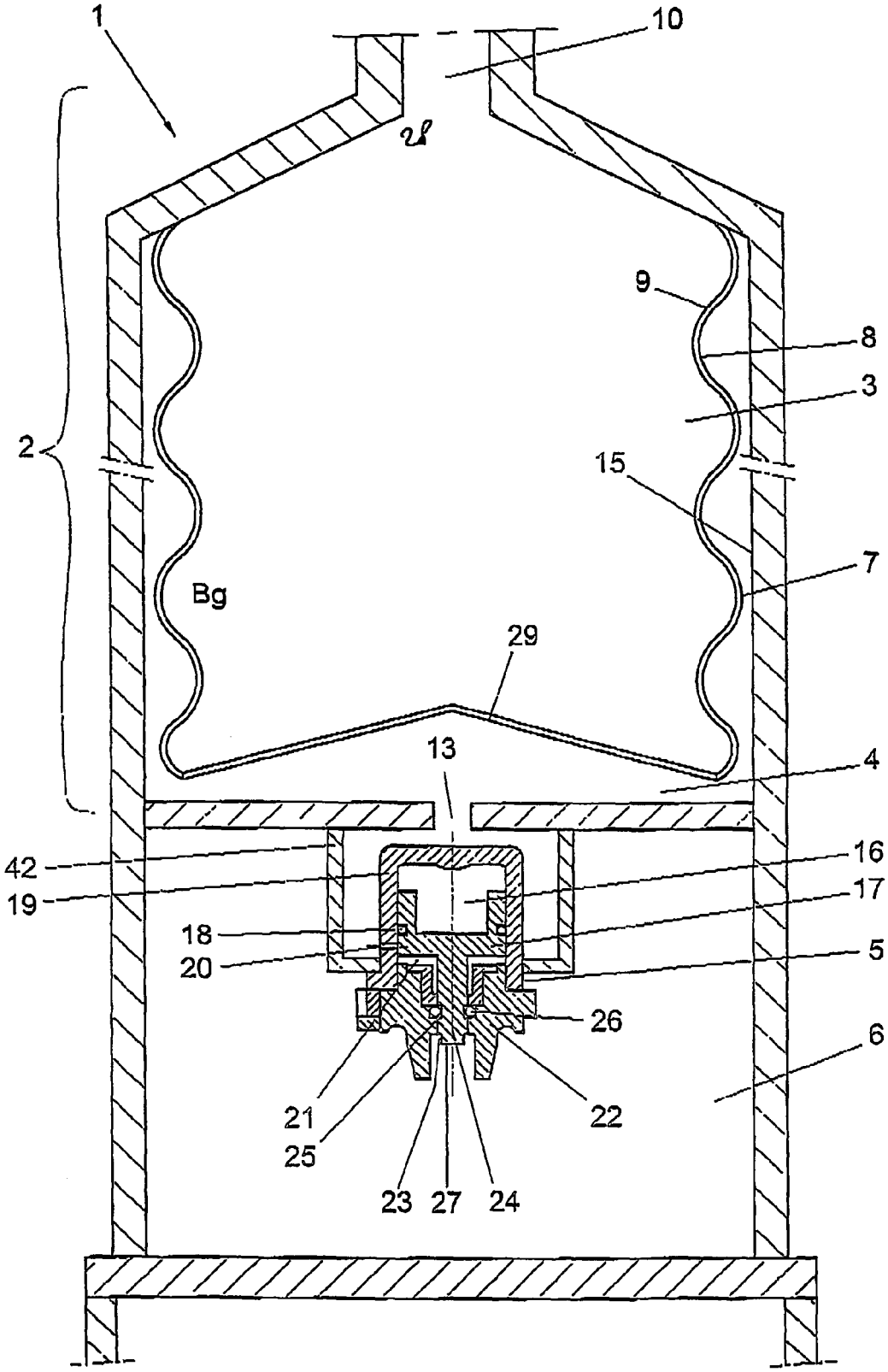
FIG. 4 schematically shows a cross section of a fourth embodiment of a pressure package system according to the invention.

FIG. 4 shows a schematic cross section of a fourth embodiment of a pressure package system according to the invention. In this case, the product chamber 3 comprises a bellows Bg with an opening 28. In this case, too, the opening 28 links up with the provision 10 provided in the pressure package 2 for opening the pressure package 2. In this case too, the wall 7 is of flexible and hence movable design. While the amount of propellant in the working pressure chamber 4 is allowed to increase via the pressure controller 5, the flexible wall 7 will fold up further. In other words, the wall 7 will be compressed in the manner of an accordion. A wall 29 bounding the working pressure chamber 4 at least partly and bounding the product chamber 3 at least partly can be of relatively stiff design in this case. This wall may correspond to the disc S such as it is shown in FIG. 2. The other features and the operation of this variant of the pressure package system according to the invention are equal to those such as they have already been indicated hereinabove in the discussion of the embodiments shown in FIGS. 1-3.

Figure 5:
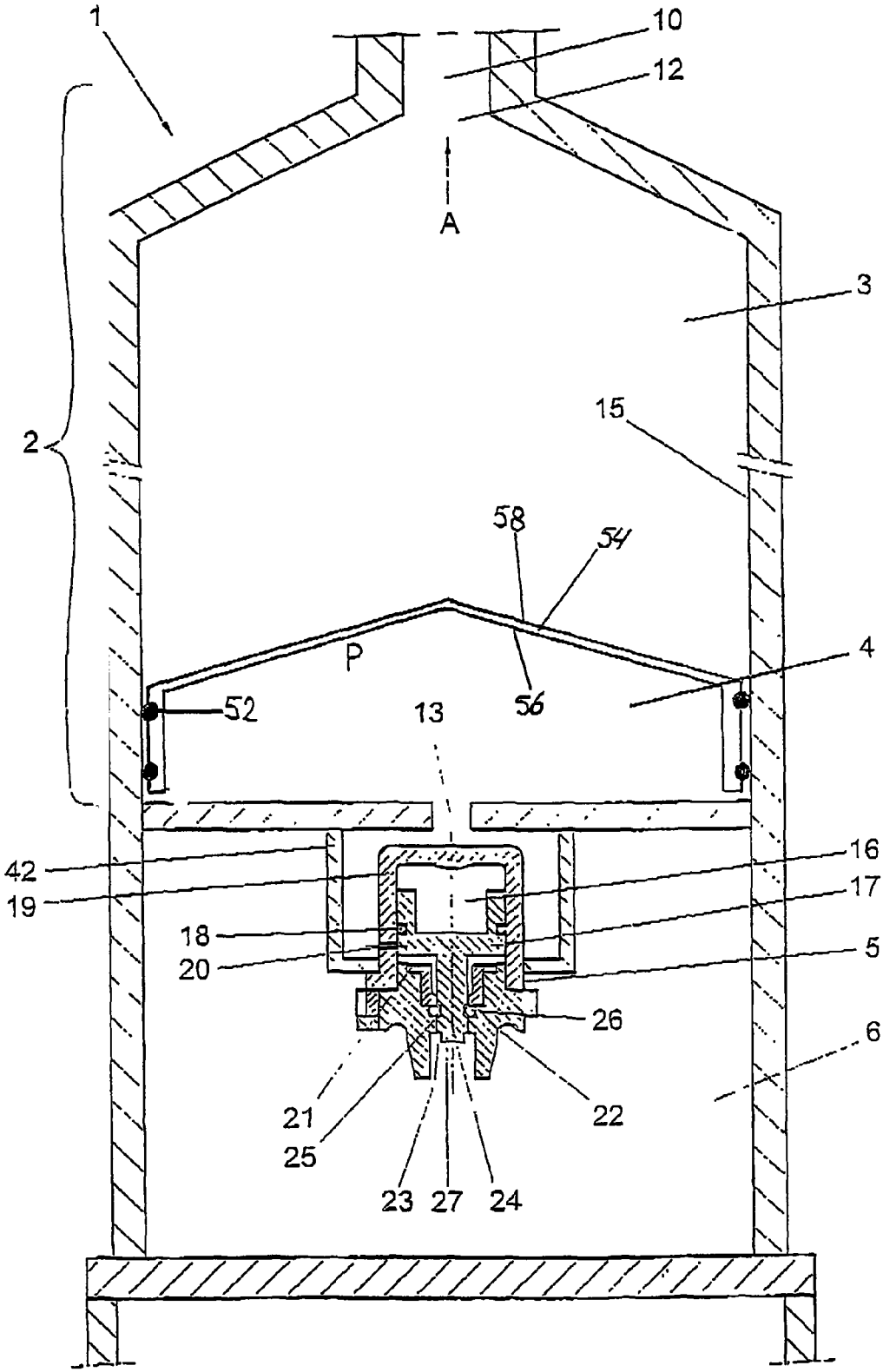
FIG. 5 schematically shows a cross section of a fifth embodiment of a pressure package system according to the invention.

FIG. 5 shows a schematic cross section of a fifth embodiment according to the invention. In this embodiment, the pressure package 2 comprises a wall 7 which comprises a slidable and hence movable plunger P. The first side 8 of the wall 7 bounds the working pressure chamber 4 at least partly. The second side 9 of the wall 7, facing away from the working pressure chamber 4, bounds the product chamber 3 at least partly. The plunger P is preferably provided with at least one sealing body 52, which constitutes a substantially gas-tight sealing between the working pressure chamber 4 and the product chamber 3. The plunger P also comprises a disc 54 which, on a side 56 facing the working pressure chamber 4, bounds the working pressure chamber 4 at least partly, and on a side 58 facing the product chamber 3, bounds the product chamber 3 partly. In the exemplary embodiment shown in FIG. 5, the disc 4 has a shape substantially corresponding to the inner wall 40 situated adjacent the first end 12 of the pressure package. In other words, instead of the balloon B shown in FIG. 1, the plunger P is included in the pressure package in the example of FIG. 5. Incidentally, the plunger P can also be designed in a different shape. Instead of two sealing rings, also a single ring can be used. The other features and the operation of this pressure package system are equal to those as described in the description of the embodiment shown in FIG. 1.

In use, as stated, a propellant will be contained in the high-pressure chamber 6. Preferably, this propellant comprises a relatively inert gas. Thus, the relatively inert gas can comprise, for instance, a gas from the group consisting of nitrogen and carbon dioxide.

In the embodiments shown, the outer wall of the pressure package merges seamlessly with the outer wall of the high-pressure chamber. In other words, one continuous outer wall is involved here.

It is possible for the system to be made of two-part design. The first part can then comprise the pressure package and the second part can then comprise the pressure controller with the high-pressure chamber. As stated and shown in the exemplary embodiments, the first part and the second part can be integrally connected with each other.

However, the invention is not limited in any way to the exemplary embodiments shown. Thus, it is possible for the first and the second part to be designed as loose items and to be connectable with each other for use. Optionally, the first and second parts are detachably connectable with each other. This makes it possible for the first part and the second part to be mechanically connected with each other, for instance with the aid of a snap connection or a threaded connection, such that the pressure controller 5 aligns with the inlet opening 13 of the working pressure chamber 4.

Preferably, in use, the pressure controller is fixed with respect to the pressure package. In all examples, the pressure controller is shown as being fixed with respect to an inner wall of the high-pressure chamber. However, what is not excluded is that the pressure controller is incorporated in the pressure package so as to be movable. Although in the embodiments shown the pressure package is made of substantially cylinder-shaped design, it is very well possible for the pressure package to be designed in other shapes. Thus, a pressure package of box-like design may be advantageous.

Although the pressure package can be manufactured substantially from metal, it is very well possible for the pressure package to be manufactured substantially from plastic material. This is because the working pressure can be relatively low, since the working pressure on the fluid contained in the product chamber 3 can be kept constant. This is a major advantage over known systems where the volume of the product chamber 3 remains constant during the use of the fluid contained in the product chamber 3. In these known systems, in the initial phase, when hardly any fluid has been taken from the product chamber 3 yet, the working pressure must be very high. This is because in these known systems, it is to be ensured that still sufficient working pressure will be exerted on the remainder of fluid still present in an almost empty product chamber 3 after the fluid has been used up almost completely.

It will be clear that the provision 10 for opening the pressure package can comprise many types of openings. To be considered here are, for instance, a screw cap, a stopper, slide, etc. Thus, it will also be clear that the wall 7 in some embodiments can be designed to be movable, flexible, elastic or a combination thereof.

It is further noted that the pressure controller may also be designed differently than the pressure controller shown. Also eligible for use are pressure controllers where the reference pressure is obtained with a spring instead of with a gas. Thus, instead of a plunger, a membrane for instance provided with a stem can be used in the pressure controller. All such variants are understood to fall within the invention.

The invention claimed is:

1. A pressure package system for pressurizing a fluid to be delivered, the system comprising:

a pressure package comprising:

a product chamber for holding the fluid, and a working pressure chamber for holding a propellant at a substantially constant working pressure, the working pressure chamber having an opening, a high-pressure chamber configured to hold propellant in supply at a pressure higher than the working pressure, a pressure controller in a fluid connection between the working pressure chamber and the high-pressure chamber, the pressure controller being disposed within the high-pressure chamber and comprising a reference pressure chamber confining a gas at a reference pressure, a cylinder in the high-pressure chamber having first and second open ends, the first open end connecting to the opening of the working pressure chamber, and the second open end being closed off by the pressure controller, and a wall movable relative to the pressure controller, the wall comprising a slidable plunger, at least a portion of a first side of the wall bounding at least a portion of the working pressure chamber and a second side of the wall facing away from the working pressure chamber, at least a portion of the second side of the wall bounding at least a portion of the product chamber;

wherein, the pressure controller is configured to supply the propellant from the high-pressure chamber to the working pressure chamber to keep the working pressure in the working pressure chamber substantially constant and the supply of the propellant to the working pressure chamber is determined based on the reference pressure.

2. A pressure package according to claim 1, characterized in that the pressure package comprises a provision for opening the pressure package for the purpose of allowing fluid operatively contained in the product chamber to flow out of the product chamber.

3. A pressure package according to claim 1, characterized in that the wall is designed to be movable relative to the pressure package.

4. A pressure package system according to claim 1, characterized in that the first side of the wall bounds the working pressure chamber substantially completely.

5. A pressure package system according to claim 1, characterized in that the product chamber is further bounded partly by the pressure package.

6. A pressure package system according to claim 1, characterized in that the second side of the wall bounds the product chamber at least substantially completely.

7. A pressure package system according to claim 6, characterized in that the working pressure chamber is further at least partly bounded by inner walls of the pressure package.

8. A pressure package system according to claim 1, characterized in that the propellant is included in the high-pressure chamber.

9. A pressure package system according to claim 8, characterized in that the propellant comprises an inert gas.

10. A pressure package system according to claim 9, characterized in that the inert gas comprises a gas from the group consisting of nitrogen and carbon dioxide.

11. A pressure package system according to claim 1, characterized in that the system is of multi-part design, with a first part comprising the pressure package and a second part comprising the pressure controller with the high-pressure chamber.

12. A pressure package system according to claim 11, characterized in that the first part and the second part are integrally connected with each other.

13. A pressure package system according to claim 11, characterized in that the first part and the second part are designed as loose items and are connectable with each other for use.

14. A pressure package system according to claim 1, characterized in that in use the pressure controller is fixed with respect to the pressure package.

15. A pressure package system according to claim 2, characterized in that the pressure package is substantially cylinder-shaped, the pressure package being provided with a first end and a second end, the pressure package being further provided with an inlet opening for the propellant situated adjacent the first end and wherein the provision for opening the pressure package is situated adjacent the second end.

16. A pressure package system according to claim 1, characterized in that the pressure package is made of a box-like design.

17. A pressure package system according to claim 1, characterized in that the pressure package is manufactured substantially from a plastic material.

18. A pressure package system according to claim 1, characterized in that the pressure controller is fixed with respect to an inner wall of the high-pressure chamber.

19. An article for pressurizing a fluid to be delivered, comprising:

a product chamber configured to hold the fluid, a working propellant chamber having a movable wall in communication with the fluid and configured to hold a propellant at a working pressure, at least a portion of a first side of the movable wall bounding at least a portion of the working propellant chamber, at least a portion of a second side of the movable wall, facing away from the working propellant chamber, bounding at least a portion of the product chamber such that the fluid is separated from the propellant, and the working propellant chamber having an opening, a reservoir propellant chamber configured to hold the propellant at a pressure higher than the working pressure, a pressure controller in a fluid connection between the working propellant chamber and the reservoir propellant chamber, the pressure controller being disposed within the reservoir propellant chamber and comprising a reference pressure chamber confining a gas at a reference pressure, the reference pressure determining the working pressure in the working propellant chamber, and a cylinder in the reservoir propellant chamber having first and second open ends, the first open end connecting to the opening of the working propellant chamber, and the second open end being closed off by the pressure controller;

wherein the movable wall is movable relative to the controller and comprises a slidable plunger, and, upon release of the fluid from the product chamber, the movable wall is configured to move to decrease a volume of the product chamber and the pressure controller is configured to deliver the propellant from the reservoir propellant chamber to the working propellant chamber to keep the working pressure within the working propellant chamber substantially constant.

20. An article for pressurizing a fluid to be delivered, comprising:

a product chamber comprising a fluid to be delivered, a working propellant chamber having a movable wall in communication with the fluid and comprising a propellant at a working pressure, at least a portion of a first side of the movable wall bounding at least a portion of the working propellant chamber, at least a portion of a second side of the movable wall, facing away from the working propellant chamber, bounding at least a portion of the product chamber such that the fluid is separated from the propellant, and the working propellant chamber having an opening, a reservoir propellant chamber comprising the propellant at a pressure higher than the working pressure, a pressure controller in a fluid connection between the working propellant chamber and the reservoir propellant chamber, the pressure controller being disposed within the reservoir propellant chamber and comprising a reference pressure chamber confining a gas at a reference pressure, the reference pressure determining the working pressure in the working propellant chamber, and a cylinder in the reservoir propellant chamber having first and second open ends, the first open end connecting to the opening of the working propellant chamber, and the second open end being closed off by the pressure controller;

wherein the movable wall is movable relative to the controller and comprises a slidable plunger, and, upon release of the fluid from the product chamber, the movable wall moves to decrease a volume of the product chamber and the pressure controller delivers the propellant from the reservoir propellant chamber to the working propellant chamber to keep the working pressure within the working propellant chamber substantially constant.

* * * * *

UNITED STATES PATENT AND TRADEMARK OFFICE

CERTIFICATE OF CORRECTION

PATENT NO. : 8,006,872 B2
APPLICATION NO. : 10/542831
DATED : August 30, 2011
INVENTOR(S) : Vanblaere et al.

It is certified that error appears in the above-identified patent and that said Letters Patent is hereby corrected as shown below:

Title Page, Col. 1 (Inventors)
Line 4, Delete "Wass" and insert -- Waas -- therefor.

Column 1
Line 13, Delete "20 Jan. 2004" and insert -- 21 Jan. 2004 -- therefor.

Column 10
Line 20, In Claim 2, after "package" insert -- system --.

Column 10
Line 25, In Claim 3, after "package" insert -- system --.

Signed and Sealed this
Twenty-fifth Day of October, 2011

David J. Kappos

David J. Kappos
*Director of the United States Patent and Trademark Office*